US007703463B2

(12) United States Patent
Dechard

(10) Patent No.: US 7,703,463 B2
(45) Date of Patent: Apr. 27, 2010

(54) METHOD OF PICKLING A HOLLOW PART IN THE FORM OF A BODY OF REVOLUTION, AND APPARATUS IMPLEMENTING SUCH A METHOD

(75) Inventor: Patrick Dechard, Vert le Petit (FR)

(73) Assignee: Snecma, Paris (FR)

( * ) Notice: Subject to any disclaimer, the term of this patent is extended or adjusted under 35 U.S.C. 154(b) by 1385 days.

(21) Appl. No.: 11/126,283

(22) Filed: May 11, 2005

(65) Prior Publication Data

US 2005/0252530 A1 Nov. 17, 2005

(30) Foreign Application Priority Data

May 17, 2004 (FR) ..... 04 05332

(51) Int. Cl.
*B05C 13/00* (2006.01)

(52) U.S. Cl. ..... 134/170; 118/409

(58) Field of Classification Search ..... 134/170
See application file for complete search history.

(56) References Cited

U.S. PATENT DOCUMENTS 2,849,097 A * 8/1958 Jackson ..... 118/416
3,335,916 A 8/1967 Juniper
3,420,712 A * 1/1969 Parsons ..... 134/33
4,046,155 A 9/1977 Mansson
5,318,683 A 6/1994 Smith et al.
2002/0129837 A1 9/2002 Ruiz et al.

FOREIGN PATENT DOCUMENTS

| | | |
|---|---|---|
| DE | 198 39 479 A1 | 3/2000 |
| JP | 4-362185 | 12/1992 |
| WO | WO 95/21952 | 8/1995 |
| WO | WO 96/15863 | 5/1996 |

* cited by examiner

*Primary Examiner*—Michael Barr
*Assistant Examiner*—Jason P Riggleman
(74) *Attorney, Agent, or Firm*—Oblon, Spivak, McClelland, Maier & Neustadt, L.L.P.

(57) ABSTRACT

Pickling the inside and the outside of a hollow part that is in the form of a body of revolution, such as, in particular, a turbine wheel made of titanium alloy. The part is mounted with its axis of revolution in a horizontal orientation and it is partially immersed in a vessel filled with pickling composition while being caused to rotate about its axis of revolution.

9 Claims, 3 Drawing Sheets

METHOD OF PICKLING A HOLLOW PART IN THE FORM OF A BODY OF REVOLUTION, AND APPARATUS IMPLEMENTING SUCH A METHOD

The invention relates to a method of pickling a hollow part in the form of a body of revolution, in particular a hollow part of large dimensions, such as, for example, a turbine wheel having annular cavities separated by disks that are welded together. The preferred field of application of the invention lies in chemically dissolving the oxygen-rich contaminated layer that forms on such a part when made of titanium alloy during heat treatment thereof, and commonly referred to as the "alpha-case" layer.

BACKGROUND OF THE INVENTION

A titanium alloy turbine wheel of the kind indicated above has the reputation of being difficult to access on the inside, given the plurality of adjacent annular cavities defined therein between the welded-together disks that constitute the wheel. The heat treatment required for preparing the part has the consequence of causing a contaminated layer to appear on the surface thereof (outside as well as inside), which layer is a few tens of micrometers thick, is rich in oxygen, and is known as the "alpha-case layer". At present, only the outside of the part is pickled, since pickling the inside has previously been considered as being risky.

Unfortunately, the presence of this contaminated layer lies behind the formation of cracks that considerably shorten the lifetime of the part.

OBJECTS AND SUMMARY OF THE INVENTION

The invention provides a pickling method that enables the contaminated layer to be dissolved simultaneously on the outside and on the inside, making sure that chemical dissolution takes place uniformly.

More particularly, the invention thus provides a method of pickling a hollow part in the form of a body of revolution, the method consisting in rotating said part about its axis of rotation in a horizontal orientation, in partially immersing said part in a vessel filled with pickling composition so that the composition penetrates into the inside of said part, in causing said part to rotate during pickling, and in continuously pumping the pickling composition from the inside of said part while maintaining the level of pickling substance substantially constant relative to said part.

The fact of immersing the part partially while simultaneously causing it to turn serves to ensure the depth of pickling is uniform over the entire surface of the part, on the inside as on the outside. In particular, this technique is preferable to mere total immersion of the part in the bath of pickling composition, which is impossible in practice because of the bubbles of air that remain trapped inside the part.

For example, the part may be immersed substantially up to its axis of rotation.

The composition as pumped out in this way is advantageously reinserted into the vessel outside the part. Given that the cavities have volumes that are different, pumping can be performed by taking the pickling composition from within the cavities, simultaneously, but while adjusting the pumping rates relative to one another, substantially in proportion to the respective volumes of the cavities.

In this way, the pickling composition inside the cavities is renewed regularly, and the composition in all of the cavities maintains the same degree of effectiveness at all times (in other words the same degree of exhaustion). For example, a plurality of pumping ducts may be provided, each dipping into a respective cavity, with the flow rate being adjusted by flow constrictions of different bore sizes.

At the end of pickling, the part is extracted from the bath of pickling composition while continuing to pump out its inside. Rotation is preferably continued while the part is being extracted. The part is extracted over a relatively short period of time, of the order of 30 seconds (S). Thereafter, the part is taken to a bath of neutralizing composition and is plunged therein. Rotation is preferably continued during this rinsing stage. The neutralizing composition may be constituted by water, for example. The contaminated layer is eliminated using a pickling composition that is constituted by a mixture of nitric acid and hydrofluoric acid, for example.

The invention also provides an installation for pickling a part in the form of a body of revolution, the installation comprising a support fitted with means for holding said part and for driving it in rotation, said means being arranged to hold and rotate the part about its axis of rotation in a horizontal orientation, a vessel of pickling composition, means for lowering said part into said vessel and for partially immersing it in said pickling composition, pump means for continuously taking pickling composition from the inside of said part, and means for maintaining a substantially constant level of pickling composition relative to said part.

The delivery outlet of the pump means is arranged to reinsert the pumped composition into the vessel, outside the part.

When the part is a rotor wheel made up of welded-together disks, the pump means may comprise a plurality of suction ducts dipping into respective ones of said cavities.

In order to make it easier to put the suction system into place, the suction ducts are flexible ducts communicating with a collector manifold connected to a single pump. These suction ducts may be provided with calibrated flow constrictions. Under such circumstances, the section of each constriction is designed as a function of the volume of the cavity in which the corresponding suction duct dips.

The installation may also include a vessel of neutralizing composition and means for transferring the part from the vessel of pickling composition to the vessel of neutralizing composition.

BRIEF DESCRIPTION OF THE DRAWINGS

The invention will be better understood and other advantages thereof will appear more clearly in the light of the following description of a pickling installation in accordance with the principle of the invention, described purely by way of example and with reference to the accompanying drawings, in which.

MORE DETAILED DESCRIPTION

Figure 1:
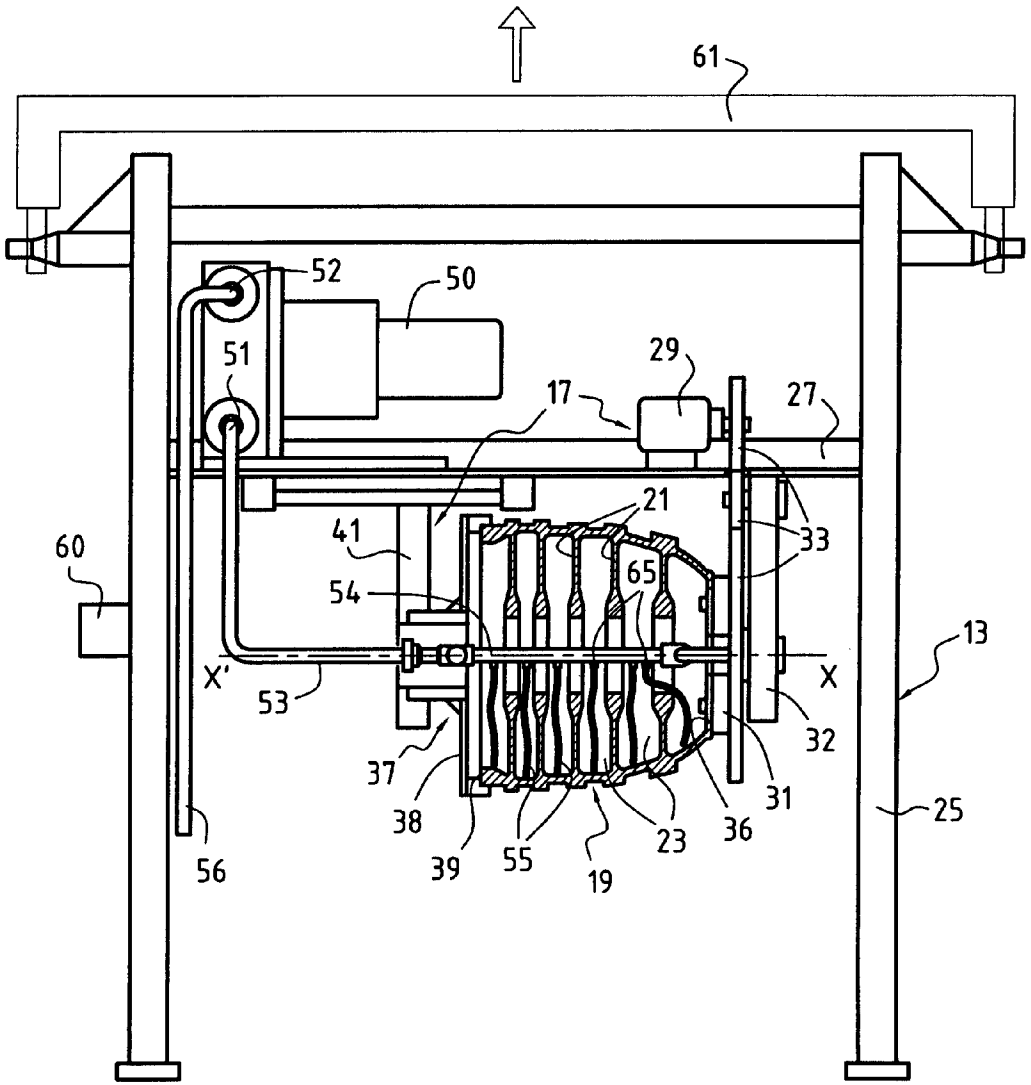
FIG. 1 is a diagrammatic elevation view, partially in section, showing an installation in accordance with the invention.

The installation 11 comprises a support 13 fitted with holding and rotary drive means 17 for holding and rotating a hollow part 19 in the form of a body of revolution that is to be pickled. It can be seen that this part constitutes the wheel or central portion of a turbojet turbine. It is a part of complex shape made up of a plurality of disks 21 welded together and defining internal cavities 23 on a common axis, axially adjacent to one another, and difficult of access. It is known that the heat treatment to which a part made of titanium alloy is subjected leads to the appearance of a contaminated layer on the surface thereof, which layer is commonly referred to as the "alpha-case layer" and desirably it should be removed. Pickling the inside surface of the part has, until now, been considered as being impossible.

The support 13 comprises a kind of gantry 25 carrying on top, on a platform 27, all of the means required for holding and rotating the part 19 (motors and electromechanical components). More precisely, an electric motor 29 rotates a support 31 of horizontal axis carried by a descender 32 extending under the platform 27. The support 31 is driven via a set of gears 33. This support is shaped and dimensioned so as to fit to one end 36 of the part. Said support 31 has plenty of perforations so as to avoid impeding the flow of a liquid inside the part, and in particular the flow of a pickling composition or a neutralizing composition, or a rinsing composition. A non-motorized rotary element 37 carries three arms 38 that fit to the other end 39 of the part. The rotary element is carried by a vertical descender 41 mounted under the platform 27. The assembly moves axially to allow the part to be put into place. Said support 31 and said rotary element 37 share the same horizontal axis. Once in place, the part is held between them and is centered by the two circular ends 36 and 39. It can thus turn about its own axis of rotation which is put into a horizontal position. Before implementing pickling, the part is moved under the gantry 25 by being carried on an elevator trolley 46 (FIGS. 2 and 3) and it is put into place between the support 31 and the arm 38. It can then be set into rotation under drive from the motor 29.

Figure 5:
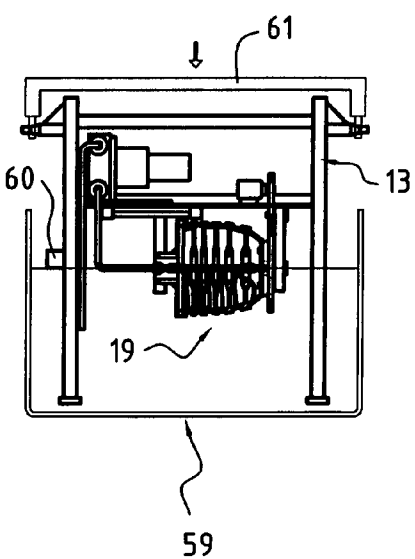

The platform 27 also has a pump 50 with its inlet 51 connected to a duct whose end 53 is disposed axially (on the axis x'x) and is connected to a rigid and separable collector 54, suitable for being installed axially inside the part, as shown. Flexible suction ducts 55 are connected to the collector 54. Each duct 55 dips into a respective one of the cavities 23 when the collector 54 and the part 19 are in place on the support 13, as shown in FIG. 1. The length of a duct depends on the cavity that corresponds thereto, so that its bottom end lies in the vicinity of the bottom wall of the part in its portion that is immersed most deeply, i.e. the bottom of said corresponding cavity. Thus, the pump means (50, 54, 55) are adapted continuously to take pickling composition from the inside of the part, and from the bottom of each cavity, while said part is partially immersed in a vessel 59 of pickling composition (FIG. 5). If the part for pickling were of some other kind, and in particular did not have a plurality of cavities, the system for providing suction inside the part could be simplified, for example it could comprise a single flexible duct dipping into the deepest portion. In addition, a level detector 60 is placed on the gantry and the insulation includes means for adjusting the position (height) of the support 13 so that said part is immersed in part up to some predetermined depth, for example, and as shown, up to its axis of rotation x'x. In the example shown, it is the entire support 13, i.e. the gantry 25 itself, that is immersed in the vessel. To do this, it is carried and transported by hoist means 61, e.g. forming part of an traveling crane or the like, installed on the site. Said hoist means enable the position of the support 13 and consequently of the part 19 to be adjusted within the vessel; said means are controlled by the level detector 60 which is fixed to the support at a location suitable for detecting the surface of the bath of pickling composition when the part is immersed substantially up to the axis x'x. The hoist means may be servo-controlled to the detected level, so as to keep the level detector 60 at the surface of the bath of pickling composition.

The installation preferably includes means for maintaining a substantially constant level of pickling composition relative to said part. Since the pump means take pickling composition from the bottom of the part, the pump 50 is arranged to recycle the pickling composition continuously into the vessel, outside the part 19. A duct 56 connected to the delivery outlet 52 of the pump dips into the vessel. In practice, this recycling serves to maintain the level of pickling composition constant within the vessel once the support 13 has been dipped therein to a depth determined by the level detector 60. Because the pickling composition is continuously pumped out from the bottoms of the cavities 23 and then recycled into the vessel outside the part, the activity of the pickling composition is maintained uniform at all points within the vessel. In order to determine the treatment time needed while taking account of the activity of the pickling composition (given that it becomes progressively exhausted), it suffices to begin by pickling a test piece that has been subjected to the same heat treatment as the part and then to deduce therefrom the time required for pickling said part.

In addition, at least some of the suction ducts 55 are provided with calibrated flow constrictions 65 (upstream from the collector 54), with the section of each constriction being determined as a function of the volume of the cavity into which the corresponding suction duct dips. This serves to keep the level of pickling composition constant within the part itself, particularly at the end of pickling during the time said part is being extracted from the vessel while continuing to be emptied.

During the treatment itself, pumping is balanced between the cavities, thus serving to make pickling within them more uniform.

The installation also includes a vessel of neutralizing composition 62 situated close to the vessel 59, and means for transferring the part 19 (in this case the assembly comprising the part and the gantry 25) from the vessel 59 to the vessel 62. These means are constituted by the above-described hoist means 61.

In the example described, where the part is made of titanium alloy, the pickling composition is a mixture of nitric acid and of hydrofluoric acid. The neutralizing composition is water.

Figure 2:
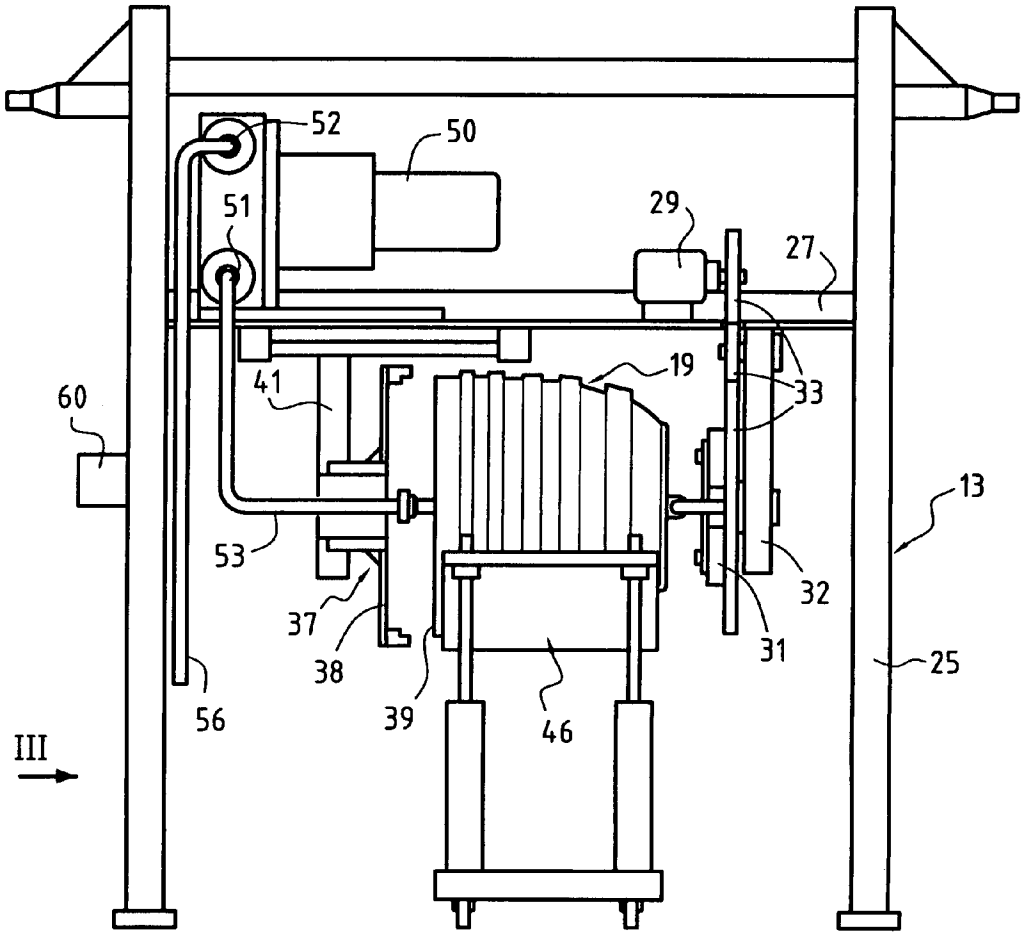
FIG. 2 is a view analogous to FIG. 1 showing more particularly how the part is put into place in the pickling installation.
Figure 3:
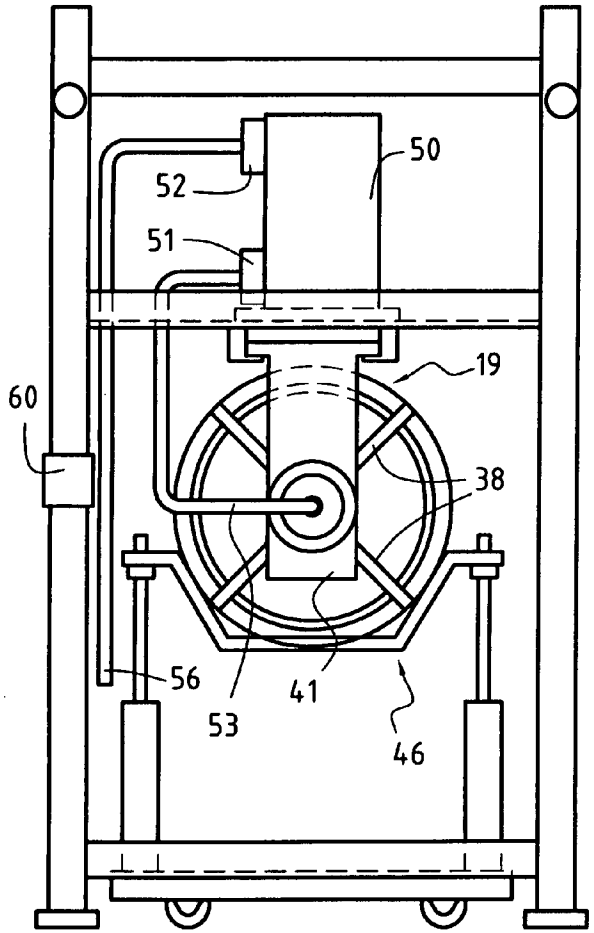
FIG. 3 is a view looking along arrow III in FIG. 2.
Figure 4:
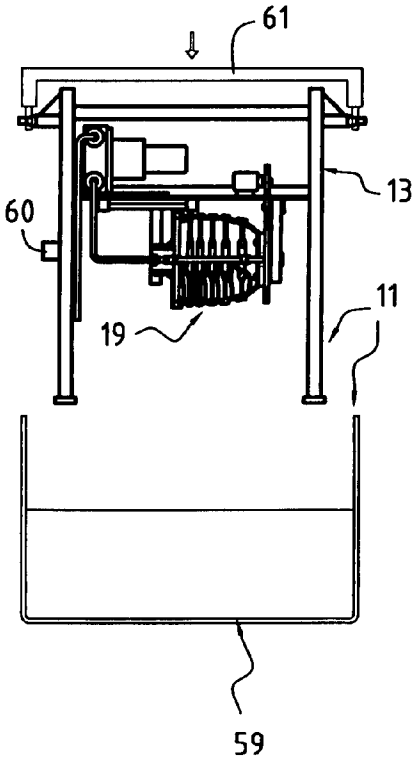
FIGS. 4 to 7 are diagrammatic views on a smaller scale showing various operations in the pickling process.
Figure 6:
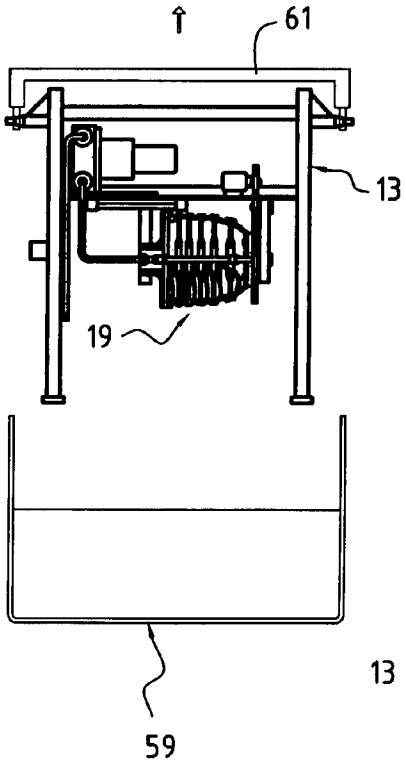
Figure 7:
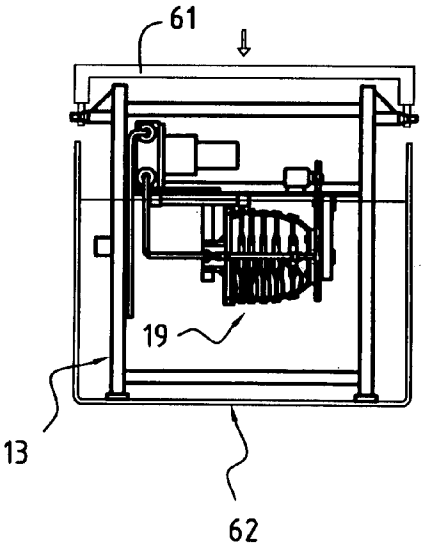

The implementation of the method stems clearly from the above description. The part is initially put into place on the support 13, as shown in FIGS. 2 and 3. The collector 54 is also put into place so that each of the flexible ducts 55 dips into a cavity. The collector is then connected to the pump 50. The situation is then as shown in FIG. 1. The support 13 is taken by the hoist means 61 and moved over the vessel 59, as shown in FIG. 4. It is lowered until the level detector 60 meets the surface of the pickling composition in the vessel 59. When the detector is triggered, the support 13 ceases to be lowered. While being lowered, the part is already being driven to rotate. Pickling takes place both externally and internally as shown in FIG. 5, with the pickling composition pumped from within the cavities being continuously recycled. As mentioned above, the flow rates of pickling composition taken from each of the cavities are adjusted relative to one another so as to be substantially proportional to the respective volumes of the cavities. This adjustment of flow rates is obtained by the flow constrictions 65 being of different bore sizes. At the end of pickling, the part is extracted from the bath by lifting the support 13 again, while continuing to pump out the inside of the part so that the level of the pickling composition that remains inside the part decreases progressively because of the pumping and remains substantially the same in all of the cavities. Once the part has been fully extracted and emptied of pickling composition (FIG. 6), it is transferred to the vessel 62 of neutralizing composition and is again immersed therein. The part is advantageously caused to rotate continuously throughout the rinsing stage, and recycling is likewise performed continuously during said stage.

What is claimed is:

1. An installation for pickling a hollow part having an axis of rotation, the installation comprising:

a support arranged with means for holding said hollow part with said axis of rotation in a horizontal orientation and with means for rotating the hollow part about said axis of rotation;

a vessel containing a pickling composition;

means for moving said support holding said hollow part up and down with respect to said vessel to enable partial immersion of said hollow part into said pickling composition, the hollow part configured to allow said pickling composition to penetrate into an inside of said hollow part;

pump means for continuously removing said pickling composition from the inside of said hollow part; and means for maintaining a substantially constant level of the pickling composition relative to said hollow part so that the pickling composition is renewed regularly inside said hollow part, wherein said pump means include a plurality of suction ducts, each duct having a suction end situated in a vicinity of an inner wall of said hollow part in a most-deeply immersed portion of said hollow part, and for pickling a rotor wheel made up of welded-together disks and including a plurality of annular cavities about an axis of rotation of the rotor wheel, a number of said suction ducts equals a number of said annular cavities, the ducts dipping into corresponding annular cavities.

2. The installation according to claim 1, wherein said support includes a level sensor, said installation further comprising means for adjusting a position of said support such that said hollow part is partially immersed up to a predetermined depth.

3. The installation according to claim 1, wherein a delivery outlet of the pump means is arranged to recycle the pickling composition in the vessel, outside said hollow part.

4. The installation according to claim 1, wherein said suction ducts are flexible hoses communicating with a collector connected to a pump.

5. The installation according to claim 1, wherein at least some of the suction ducts are provided with calibrated flow constrictions, with a section of each constriction being determined as a function of a volume of the annular cavity in which corresponding suction duct dips, so that pumping is balanced between the cavities, thus making pickling more uniform within said cavities.

6. The installation according to claim 1, including a vessel of neutralizing composition and means for transferring said support holding said hollow part from the vessel containing the pickling composition to a vessel of neutralizing composition.

7. The installation according to claim 6, wherein said pickling composition is a mixture of hydrofluoric acid and of nitric acid.

8. The installation according to claim 6, wherein said neutralizing composition is water.

9. The installation according to claim 2, wherein said hollow part is immersed substantially up to the axis of rotation of the hollow part.

* * * * *